US010174512B2

(12) United States Patent
Van Oers et al.

(10) Patent No.: US 10,174,512 B2
(45) Date of Patent: Jan. 8, 2019

(54) SUSPENDED SCAFFOLDING AND SUSPENDING DEVICE THEREFORE

(71) Applicant: BRAND ENERGY HOLDINGS B.V., Vlaardingen (NL)

(72) Inventors: Petrus Christianus Johanna Maria Van Oers, Nuenen (NL); Ralph Gerardus Franciscus Herman Kweens, Boxtel (NL); Cornelus Jacobus Scholten, Beverwijk (NL)

(73) Assignee: Brand Energy Holdings B. V., Vlaardingen (NL)

( * ) Notice: Subject to any disclaimer, the term of this patent is extended or adjusted under 35 U.S.C. 154(b) by 0 days.

(21) Appl. No.: 15/024,045

(22) PCT Filed: Sep. 22, 2014

(86) PCT No.: PCT/NL2014/050650

§ 371 (c)(1),
(2) Date: Mar. 23, 2016

(87) PCT Pub. No.: WO2015/041535

PCT Pub. Date: Mar. 26, 2015

(65) Prior Publication Data

US 2016/0230405 A1 Aug. 11, 2016

(30) Foreign Application Priority Data

Sep. 23, 2013 (NL) ..... 2011487

(51) Int. Cl.

| | |
|---|---|
| ***E04G 3/22*** | (2006.01) |
| ***E04G 3/28*** | (2006.01) |
| ***E04G 5/04*** | (2006.01) |

(52) U.S. Cl.

CPC ..... *E04G 3/22* (2013.01); *E04G 3/28* (2013.01); *E04G 5/045* (2013.01); *E04G 2003/283* (2013.01)

(58) Field of Classification Search

CPC ..... E04G 3/22; E04G 3/28; E04G 3/30
See application file for complete search history.

(56) References Cited

U.S. PATENT DOCUMENTS

| | | | | |
|---|---|---|---|---|
| 1,929,325 A * | 10/1933 | Masterson | ..... | E04G 3/28 105/150 |
| 2,206,328 A * | 7/1940 | Martinek | ..... | A63G 9/12 248/340 |
| 2,925,240 A * | 2/1960 | Laviolette | ..... | E04G 3/28 104/98 |

(Continued)

OTHER PUBLICATIONS

Tryfonas, N., International Search Report, PCT Patent Application No. PCT/NL2014/050650 dated Jan. 19, 2015.

*Primary Examiner* — Colleen M Chavchavadze
(74) *Attorney, Agent, or Firm* — Perry + Currier Inc.

(57) ABSTRACT

A suspended scaffold comprises a work platform (6) and at least one suspending device (2) via which the work platform (6) is attachable to an object (1). The suspending device (2) comprises a claw device (3) intended and configured to engage optionally directly on the object (1), and a coupling device (4). The claw device (3) is adjustable relative to the coupling device (4) between a first position (21) and a second position (22). The second position (22) lies spatially offset relative to the first position (21).

14 Claims, 3 Drawing Sheets

(56) References Cited

U.S. PATENT DOCUMENTS

| | | | | | |
|---|---|---|---|---|---|
| 2,926,880 | A | * | 3/1960 | Bourgeois | E04G 3/22<br>182/150 |
| 2,930,441 | A | * | 3/1960 | Lacy | E04G 3/28<br>182/14 |
| 2,980,384 | A | * | 4/1961 | Leonard | E04G 3/28<br>182/142 |
| 3,096,064 | A | * | 7/1963 | Leonard | E04G 3/28<br>248/323 |
| 4,200,955 | A | * | 5/1980 | Kitchen | E04G 3/22<br>16/106 |
| 4,271,927 | A | * | 6/1981 | Brown | E04G 3/28<br>105/154 |
| 4,276,959 | A | * | 7/1981 | Barber | B63C 5/02<br>182/136 |
| 4,660,678 | A | * | 4/1987 | Krag | B62D 57/00<br>182/14 |

* cited by examiner

SUSPENDED SCAFFOLDING AND SUSPENDING DEVICE THEREFORE

The present invention relates to a suspended scaffold comprising a work platform and at least one suspending device via which the work platform is attachable to an object in order to enter into a suspended spatial relation therewith, wherein the suspending device comprises a claw device intended and configured to engage optionally directly on the object and a coupling device which extends from the work platform at a first outer end and which is coupled to the claw device at an opposite second outer end.

Suspended scaffolds are applied on a large scale in the maintenance and repair operations on for instance industrial installations, bridges, buildings and other large-scale objects. The suspended scaffold is attached here via a number of suspending devices to a suitable mounting base of the object. The suspended scaffold in this way provides a work platform at height without a support scaffold or other construction or device being necessary for this purpose from the ground.

A drawback of using a suspended scaffold is however that, precisely at the locations where the suspending device of the suspended scaffold engages on the object, the intended operations cannot be carried out. Particularly that part of the object under the claw device is not accessible for maintenance or repair comprising of at least for instance abrasive blasting and/or coating operations on the object. In order to also enable treatment of these relatively small locations a conventional suspended scaffold has to be displaced in its entirety in order to expose these parts, or another solution has to be sought, such as so-called rope access, in order to finish the as yet untreated locations. This is time-consuming, laborious and therefore relatively costly, and results in the latter case in a lesser result.

The present invention has for its object, among others, to provide a suspended scaffold which obviates this drawback, while such a major displacement of the suspended scaffold in its entirety need not here be carried out.

In order to achieve the stated object a suspended scaffold of the type stated in the preamble has the feature according to the invention that the claw device is adjustable relative to the coupling device between a first position and at least one second position, which at least one second position lies spatially offset relative to the first position at least transversely of a longitudinal axis defined between the first outer end and the second outer end of the coupling device. The at least one suspending device thus provides for an adjustability of the claw device relative to the object whereby the suspended scaffold as a whole can remain in place while only the claw bodies are adjusted between the first position and the second position so as to thus expose the previous position so that the intended operations can also be performed on the object at that position. It will be self-evident that this can be done considerably more efficiently than by displacing the suspended scaffold in its entirety.

A preferred embodiment of the suspended scaffold according to the invention is characterized in that the coupling device has a length which is adjustable at least substantially along the longitudinal axis. The coupling device can thus be lengthened before adjustment of the claw device, whereby the claw device is relieved of the hanging weight of the suspended scaffold previously still exerted thereon. The adjustment of the claw device can subsequently be performed manually with relatively little expenditure of effort and optionally without tools.

The adjustability of the claw body can be realized per se in various ways, for instance by a rotation and/or translation of this component relative to the coupling device. In a further preferred embodiment the suspended scaffold according to the invention is however characterized in that the claw device is axially displaceable between the first position and the at least one second position relative to the coupling device. A simple axial translation in transverse direction thus suffices to vary the claw device between the first and at least one second position.

Although the first and at least one second position can transpose continuously into each other, it is recommended to have positions defined for this purpose. With a view hereto a particular embodiment of the suspended scaffold according to the invention has the feature that the first position and the at least one second position are defined by at least one receiving member extending from a first of the claw device and the coupling device and a receiving cavity provided on a second of the claw device and the coupling device. The first and at least one second position are thus defined by the receiving cavities for the purpose of receiving the receiving member therein in the respective positions. In a further particular embodiment the suspended scaffold according to the invention is characterized here in that the at least one receiving cavity comprises a number of cup-shaped recesses in a base part of the claw device which open on a side remote from the platform, and that the receiving member comprises a protrusion extending from an outer end of the coupling device so as to be received in one of the recesses.

At least one alternative position in which the claw device can be placed will suffice per se in order to expose the object at the previous position. However, a particular embodiment of the suspended scaffold which will be highly practical in practice has the feature according to the invention that the at least one second position comprises at least a first second position and a second position between which the first position is located. There is therefore a choice between at least one second position on either side of the first position of the claw device whereby, depending on the space available on the object, the claw device can be adjusted to the right as well as to the left.

In order to avoid the undesirable possibility of the claw device breaking loose from one of the positions or otherwise leaving its position, a further particular embodiment of the suspended scaffold according to the invention has the feature that locking means are provided to secure the claw device and the coupling device relative to each other in the first and at least one second position. The claw device can thus be secured in said positions. In a more particular embodiment the suspended scaffold is further characterized here in that the locking means comprise a locking pin and, for each position of the claw device, a locking cavity for receiving the locking pin.

An adjustment of the claw device relative to the coupling device can in some circumstances result in undesirable moments of force developing between a point of engagement on the object and the coupling device. In order to prevent these, or at least compensate therefor, a further preferred embodiment of the suspended scaffold according to the invention has the feature that the claw device comprises a support device extending laterally therefrom so as to thereby support on the object on the side of the claw member. The support device is thus able to restore in the suspension a static equilibrium from which no or hardly any net moments of force emanate. In a more particular embodiment the suspended scaffold according to the invention has the feature here that the claw device comprises a laterally accessible receiving cavity in which a lying part of the support device is received in axially adjustable manner, and that the support device comprises a support which extends from the lying part and which is intended and configured to support against the object. The support device is thus laterally adjustable so that it can be positioned at a suitable location on the object.

Effective positioning and adjustment of the support device is further enhanced by a further particular embodiment of the suspended scaffold according to the invention, which is characterized for this purpose in that the support is adjustable substantially transversely of the lying part and particularly comprises a screw spindle which engages in an at least substantially complementary threaded cavity in the lying part. The lying part can be positioned laterally in optimal manner, after which the support can be set so as to support in at least substantially clearance-free manner against the object. When the suspending device is subsequently loaded, this will result at least mainly in only a static player forces and equilibrium.

In order to enable engagement on objects of varying dimensions and varying shape a further particular embodiment of the suspended scaffold according to the invention has the feature that the claw device comprises an adjustable jaw which is adjustable between an opened position, in which the jaw is placeable round a part of the object, and a closed position in which the jaw hooks, in particular clamps, round the part of the object, and more particularly that the jaw is axially adjustable in the transverse direction. The jaw can thus be placed in opened situation round a part of the object and subsequently closed around it.

In order to avoid damage to the object, particularly at a position where maintenance has just taken place, at the position where the claw device engages thereon, a further particular embodiment of the suspended scaffold according to the invention has the feature that the jaw comprises a protective lining at least at the position of contact with the object, and more particularly that the lining extends from a cylinder surface of projections provided for this purpose on the jaw. The protective lining can be composed here of a relatively soft and optionally resilient material, such as in particular from a suitable plastic. By providing projections on the jaw which have a cylindrical surface with which the projections enter into contact with the object, the contact surface can be limited to a minimum while the lining provides protection at the position of this contact surface.

The invention also relates to a suspending device of the type as applied in the above described suspended scaffold according to the invention, and will now be further elucidated with reference to an exemplary embodiment and an accompanying drawing. In the drawing.

Figure 2:
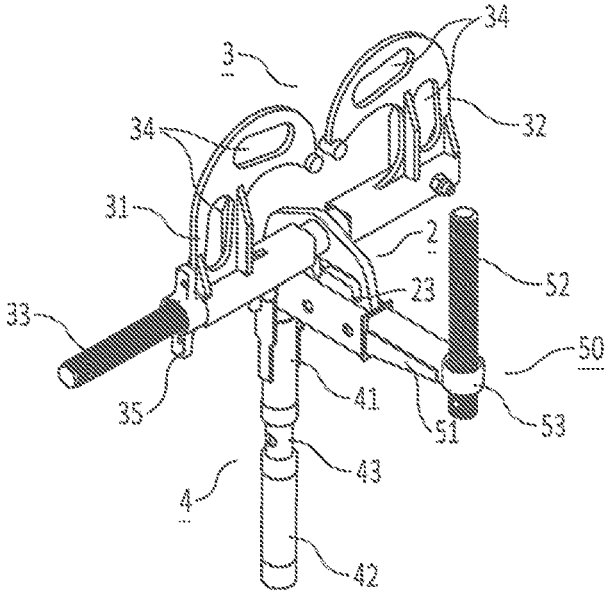
FIG. 2 is a perspective view of an exemplary embodiment of a suspending device according to the invention as applied in the suspended scaffold of FIG. 1.
Figure 4C:
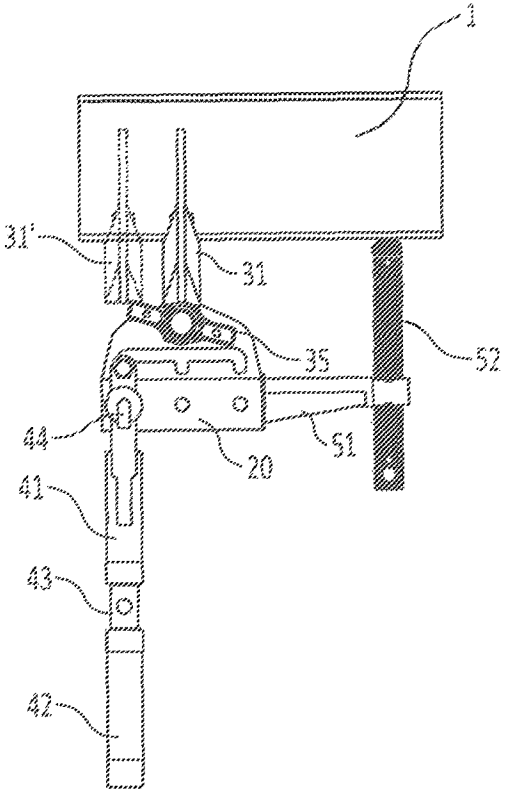
Figure 4B:
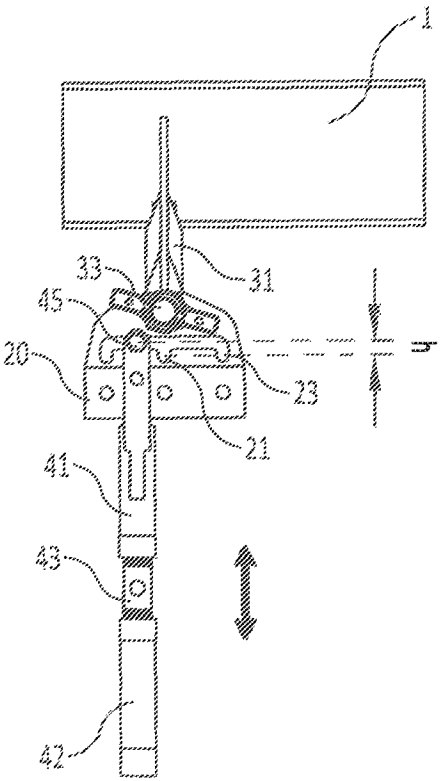
Figure 4A:
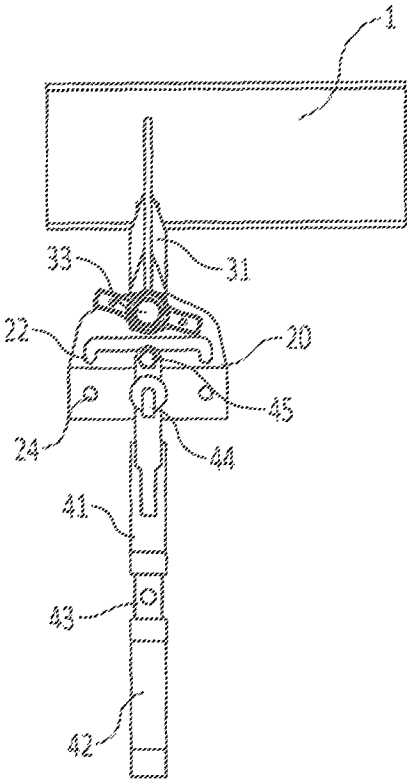

FIGS. 4A-C show the suspending device of FIG. 2 at successive stages of adjustment.

The figures are otherwise purely schematic and not drawn to scale. Some dimensions in particular may be exaggerated to greater or lesser extent for the sake of clarity. Corresponding parts are designated in the figures with the same reference numeral.

Figure 1:
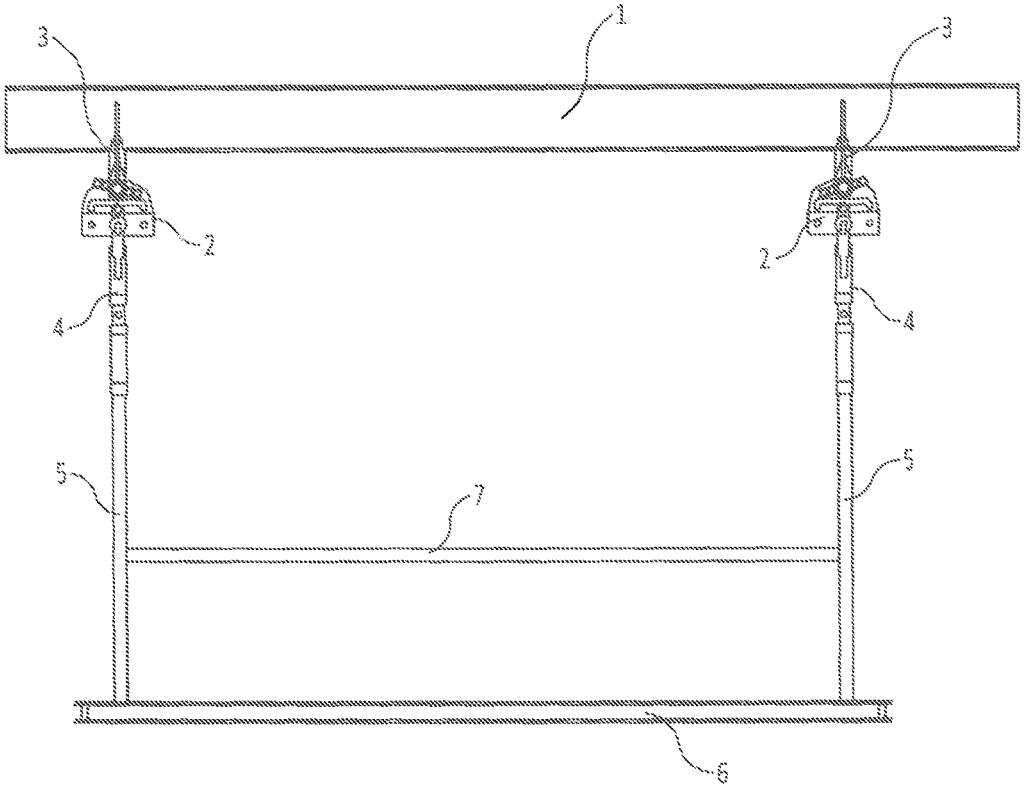
FIG. 1 shows a view of an exemplary embodiment of a suspended scaffold according to the invention.

FIG. 1 shows an exemplary embodiment of a suspended scaffold according to the invention. Such suspended scaffolds are normally applied at (greater) height for repair and building operations on objects such as industrial installations, buildings, bridges and so on. In the shown case the suspended scaffold is suspended from an H-beam 1 forming part of the object in question. For this purpose the suspended scaffold comprises a set of suspending devices 2 according to an embodiment of the invention which extend from a set of uprights 5 of a work platform 6. Work platform 6 is elongate and rectangular and comprises at each corner point such an upright 5 with suspending device 2, two of which are shown in the view of FIG. 1. The suspended scaffold also comprises one or more girders and/or other cross braces 7 which span the space between uprights and thereby form a safety rail. It is thus possible to work safely at height from the suspended scaffold.

Figure 3:
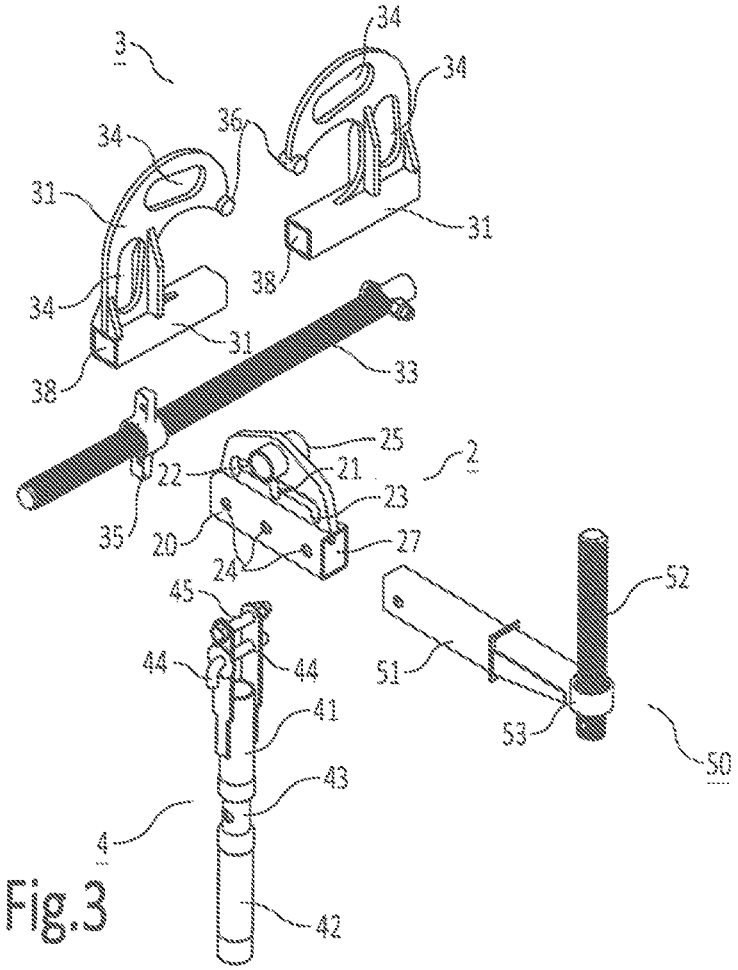
FIG. 3 is an exploded view of the suspending device of FIG. 2.

Suspending device 2 comprises an adjustable jaw 3 with which object 1 is engaged as shown by way of example in FIG. 1. This has the inevitable consequence that under the jaw a surface treatment cannot be carried out on object 1, such as for instance abrasive blasting or painting of H-beam 1. In order to avoid the whole suspended scaffold having to be rehung in order to also be able to reach these locations, suspending device 2 takes an adjustable form according to the invention. The construction of suspending device 2 is set forth in more detail in FIGS. 2 and 3.

The adjustable jaw 3 forms part of a claw device and comprises two jaw parts 31,32 which are arranged for axial movement over a screw spindle 33. Screw spindle 33 is carried with a free outer end through a cavity 38 in second jaw part 32 so as to be received in freely movable manner in a bore 25 of a base part 20 of the suspending device and in a corresponding cavity 38 in first jaw part 31. Jaw parts 31,32 are thus axially adjustable over screw spindle 33 and can move toward each other from a spread position to the clamping position shown in the figures in which they hook round object 1. Recesses 34 provided in the jaw parts can be used here as handle to enable sufficient manual force to be exerted thereon. A wing nut 35 running over screw spindle 33 can be tightened in order to fix jaw parts 31,32 in this situation wherein jaw 3 engages round beam 1.

In order to minimize the contact surface of jaw 3 with object 1 the jaw is provided internally with a set of barrel-shaped projections 36 which lie with a cylindrical surface on the object and thereby limit the actual contact to a boundary line. Jaw parts 31,32 including projections 36 are moreover lined on their side facing toward the object with a plastic lining (not shown) in order to protect the surface of the object against scratching or other mechanical action.

Base part 20 of the claw device comprises a set of receiving cavities in the form of a set of recesses 21,22,23 which open on a side remote from platform 6 in order to receive therein a receiving member in the form of a protrusion 45 extending from a coupling device 4.

Coupling device 4 thus hangs with protrusion 45 in a first recess 21 which thereby defines a first position of the two components 3,4 relative to each other. Corresponding to the first recess 21 is a locking cavity 24 in which is received a locking pin 44 which extends from coupling device 4 and fixes both parts relative to each other in this situation, see also FIG. 4A.

The coupling device is axially adjustable in the length. The coupling device comprises for this purpose a set of tube parts 41,42 in co-action with a rod body 43 which engages with an external screw thread on an internal screw thread in a central cavity in each of the tube parts 41,42. By rotating the rod body 43 in both tube parts it is possible, depending on the rotation direction, to thus adjust coupling device 4 so that it is axially shorter or longer. A cavity or bore in rod body 43 provides a point of engagement here for a hand tool such as a screwdriver, bar, hexagonal key or threaded end and the like. When the device is assembled the screw thread of the height adjustment is screwed fully closed and thereby not visible. This is also a clear reference during assembly and disassembly which also indicates that the device has been correctly mounted, and moreover provides protection to the screw thread when for instance abrasive blasting operations are being carried out on the object.

In order to adjust the suspending device the locking pin 44 is removed and coupling device 4 then lengthened in the above described manner, see FIG. 4B. The screw thread now becomes visible, indicating that the device is in an adjusted position. The axial adjustment (h) is indicated schematically by means of an arrow. Protrusion 45 of the coupling device hereby moves out of first recess 21 and the associated upright 5 is released. After loosening of wing nut 35 the claw device can now be freely adjusted laterally in order to be displaced from first recess 21 to one of the two second recesses 22,23. These second recesses each define a second position of claw device 3 relative to the coupling device and each lie in the order of 60 mm laterally offset relative to a central axis of the coupling device, see FIG. 4C. In each of these two second positions jaw 3 hereby lies in the order of 60 mm offset relative to the first position of FIG. 4A, which is shown by way of illustration in broken lines in FIG. 4C. Wing nut 35 is now tightened again in order to cause the jaw to grip round the object in this situation.

A support device 50 is provided in order to avoid undesirable moments of force being exerted on the suspending device in the case of a load thereon in this position. The support device comprises a lying part 51 which is inserted into a cavity 27 provided for this purpose in base part 20. The support device further comprises a support in the form of a screw spindle 52 which extends transversely from a threaded cavity 53 of lying part 51. The support can thus be adjusted in height direction so as to finally support firmly against object 1 laterally of the suspending device on a side remote from the second recess, see FIG. 4C.

Locking pin 44 is now arranged in locking cavity 24 corresponding to this second position of the suspending device. The length of coupling device 40 is then reduced to its original length by rotating the rod body in opposite direction as far as a stop, wherein the screw thread is once again screwed fully closed. The suspending device can now be fully loaded again, although the jaw now engages at another position on the object so that this latter can be treated at the original position without the whole suspended scaffold having to be rehung for this purpose or an alternative treatment method having to be performed. The suspended scaffold according to the invention hereby provides a great practical advantage compared to conventional suspended scaffolding.

Although the invention has been further elucidated above on the basis of only a single embodiment, it will be apparent that the invention is by no means limited thereto. On the contrary, many other variations and embodiments are possible for the person with ordinary skill in the art without having to depart from the scope of the invention. Use is thus made in the shown exemplary embodiment of a suspended scaffold with suspending device which is manufactured substantially from optionally preserved steel, although it is also possible instead to opt for aluminium or another material for one or more of the parts in order to save weight.

Use is further made in the exemplary embodiment of an adjustment of the claw device by means of a translation of the base part thereof relative to the suspending device. A claw body can instead be applied with a base part which allows a rotation for the purpose of moving from the one position to the other. Intermediate forms are likewise possible.

The invention claimed is:

1. A suspended scaffold comprising:

a work platform;

at least one suspending device via which the work platform is attachable to an object in order to enter into a suspended spatial relation therewith, wherein the at least one suspending device comprises a claw device, said claw device having a pair of claw members that is intended and configured to engage the object; and a coupling device, said coupling device having a first outer end and an opposite second outer end, wherein said coupling device extends from the work platform at said first outer end and couples to the claw device at said second outer end, wherein the claw device is displaceable relative to the coupling device between a first position, in which said claw members engage the object at a first location, and at least one second position, in which said claw members engage the object at a second location, wherein the at least one second position and the second location lie spatially offset relative to the first position and the first location, respectively, such that said claw members expose said object at said first location when said claw device is in said second position, wherein the coupling device has a length which is adjustable at least substantially along a longitudinal axis; and wherein there is a base component coupled between the claw device and the coupling device, the base component comprising a number of receiving cavities, wherein a first of the receiving cavities corresponds to the first location and a second receiving cavity corresponds to the second location and the coupling device can be moved from the first location to the second location prior to movement of the claw device from the first location to the second location.

2. The suspended scaffold as claimed in claim 1, characterized in that the claw device is axially displaceable between the first position and the at least one second position relative to the coupling device.

3. The suspended scaffold as claimed in claim 1, characterized in that at least one receiving cavity, of the number of receiving cavities, comprises a number of recesses in a base part of the claw device which open on a side remote from the work platform, and that the receiving member comprises a protrusion extending from an outer end of the coupling device so as to be received in one of the recesses.

4. The suspended scaffold as claimed in claim 1, characterized in that the at least one second position comprises a first second position and at least one further second position between which the first position is located.

5. The suspended scaffold as claimed in claim 1, characterized in that locking means are provided to secure the claw device and the coupling device relative to each other in the first position and at least one second position.

6. The suspended scaffold as claimed in claim 5, characterized in that the locking means comprise a locking pin, the locking pin received in a different receiving cavity of the number of receiving cavities, for each respective position of the claw device.

7. The suspended scaffold as claimed in claim 1, characterized in that the claw device comprises a support device extending laterally therefrom configured to rest against the object.

8. The suspended scaffold as claimed in claim 7, characterized in that the claw device comprises a laterally accessible receiving cavity in which a lying part of the support device is received in axially adjustable manner, and that the support device comprises a support member which extends from the lying part and which rests against the object.

9. The suspended scaffold as claimed in claim 8, characterized in that the support device is adjustable substantially transversely of the lying part and particularly comprises a screw spindle which engages in an at least substantially complementary threaded cavity in the lying part.

10. The suspended scaffold as claimed in claim 1, characterized in that the claw device comprises an adjustable jaw which is adjustable between an opened position, in which the adjustable jaw is placeable round a part of the object, and a closed position in which the adjustable jaw hooks round the part of the object.

11. The suspended scaffold as claimed in claim 10, characterized in that the jaw is axially adjustable in a transverse direction.

12. The suspended scaffold as claimed in claim 10, characterized in that the jaw comprises a protective lining at least at a position of contact with the object.

13. The suspended scaffold as claimed in claim 12, characterized in that the lining extends from a cylinder surface of projections provided for this purpose on the jaw.

14. The suspended scaffold as claimed in claim 10, characterized in that the jaw comprises clamps.

* * * * *